United States Patent [19]

Suzuki et al.

[11] 3,986,061

[45] Oct. 12, 1976

[54] PIEZOELECTRIC IGNITION DEVICE

[75] Inventors: Kazuma Suzuki, Fuchu; Takahiro Kurosawa, Tokyo, both of Japan

[73] Assignee: Rion Co., Ltd., Tokyo, Japan

[22] Filed: Dec. 12, 1974

[21] Appl. No.: 532,025

[30] Foreign Application Priority Data

| | | |
|---|---|---|
| Mar. 12, 1974 | Japan | 49-29093[U] |
| Apr. 22, 1974 | Japan | 49-46056[U] |
| May 13, 1974 | Japan | 49-53128 |

[52] U.S. Cl. ..... 310/9.8; 310/8.5; 310/8.7; 310/9.1

[51] Int. Cl.[2] ..... H01L 41/08

[58] Field of Search ..... 310/8.3, 8.5, 8.6, 8.7, 310/9.1, 9.4, 9.8; 317/DIG. 11

[56] References Cited

UNITED STATES PATENTS

| | | | |
|---|---|---|---|
| 2,540,412 | 2/1951 | Adler | 310/9.1 X |
| 2,640,889 | 6/1953 | Cherry, Jr. | 310/8.6 X |
| 2,836,737 | 5/1958 | Crownover | 310/8.6 X |
| 2,864,013 | 12/1958 | Wood | 310/8.6 X |
| 2,875,353 | 2/1959 | Cavalieri, Jr. et al. | 310/8.5 |
| 2,928,052 | 3/1960 | Wood | 310/8.5 X |
| 3,295,024 | 12/1966 | Newman | 317/DIG. 11 |
| 3,366,808 | 1/1968 | Steward | 310/8.3 |
| 3,397,328 | 8/1968 | Schafft | 310/8.3 X |
| 3,464,531 | 9/1969 | Herr et al. | 310/8.3 X |
| 3,500,451 | 3/1970 | Yando | 310/8.5 |
| 3,586,888 | 6/1971 | Dorfman | 310/8.3 |
| 3,603,709 | 9/1971 | Retzler | 317/DIG. 11 |

*Primary Examiner*—Mark O. Budd

*Attorney, Agent, or Firm*—Leydig, Voit, Osann, Mayer & Holt, Ltd.

[57] ABSTRACT

A piezoelectric ignition device for spark-igniting a fuel of such burning instruments as cigaret lighters, gas ranges and the like, utilizing a high electric voltage obtained by giving a bending stress in lengthwise direction to an elongated rectangular plate-shaped porcelain piezoelectric element. A plurality of electrodes is formed at least on one of the surfaces of the plate-shaped element along the respective lines parallel to lengthwise both ends and dividing the element lengthwise into "*n*" divisions, and adjacent divisions are polarized reversely to each other also in the lengthwise direction. A force-to-electricity conversion is made with a piezoelectric constant $g_{33}$.

21 Claims, 22 Drawing Figures

PIEZOELECTRIC IGNITION DEVICE

This invention relates to piezoelectric igniting devices.

Devices for spark-igniting cigaret lighters, gas ranges, gas stoves and the like apparatuses using piezoelectic porcelains has already been widely prevalent but most of them have been of a structure of impact type in which a striker is caused to strike or collide with a columnar type piezoelectric porcelain element and which has defects of generating impact vibration and impact sound at the time of the operation. In order to solve such problems, there have been suggested various devices of so-called squeezing type wherein a high voltage is generated by applying a static pressure to the similarly columnar type porcelain element. However, in any of the conventional devices of this kind, a static pressure has been applied in the axial direction of the columnar element and there has been such problems that it is difficult to make the mechanism small and to operate the device with a small force in order to obtain sufficiently high voltage.

The present invention has been suggested to remove the above mentioned defects of conventional devices, that is, to provide an ignition device which is small in the size and operable with a small operating force to generate a high voltage required. The present invention has successfully solved the problem with an improved piezoelectric igniting device, wherein a plurality of electrodes is formed by any proper measure known on at least one surface of an elongated rectangular plate-shaped porcelain element, along the respective lines dividing the length of such plate-shaped porcelain element into $n$ equal divisions, and the adjacent ones of such divisions are polarized reversely to each other so that electric outputs from the respective divisions generated due to a bent deformation of the element will be superposed and impressed on the discharging electrodes to generate a spark discharge.

An object of this invention is to provide an ignition device of small and simple structure and of which operating mechanism is made small and simple by using a piezoelectric porcelain element which well operates with a small operating force so as to be effectively applied to gas ranges and the like and, specifically, to such small burning instruments as hand lighters.

Another object of the present invention is to provide an ignition device wherein divided electrodes are provided so as to equally divide the length of an elongated rectangular plate-shaped porcelain element into $n$ divisions and the respective adjacent ones of such divisions are polarized reversely to each other in the lengthwise direction so that electric outputs from the respective divisions generated due to a bent deformation will be taken out as superposed on one another so as to render the total capacitance remarkably large, thereby to minimize the energy loss and increase the ignition efficiency.

A further object of the present invention is to provide a piezoelectric ignition device wherein a reinforcing plate made of a metal and an insulator or either one of them is bonded and coupled to an elongated plate-shaped porcelain piezoelectric element, on which electrodes are formed along the respective lines dividing the length of the element into a plurality of divisions so that a spark-ignition will be made by utilizing a high voltage due to a piezoelectric constant $g_{33}$ generated when a bending stress is given to compress the porcelain piezoelectric element, or to cause a bent-deformation thereof, in the lengthwise direction, or when the element restores as the stress is released after causing the compression or deformation.

Another object of the present invention is to provide a piezoelectric ignition device wherein a discharge spark is generated with an output of one polarity generated in a piezoelectric element of the type referred to in the above and a residual voltage of a polarity reverse to it is properly short-circuited or leaked.

The present invention shall now be explained in detail with reference to certain preferred embodiments of the invention shown in attached drawings, in which:

FIG. 11 shows the embodiment of FIG. 10 as disassembled, wherein

FIG. 12 shows the piezoelectric element unit of the embodiment of FIG. 10, wherein

Figure 1:
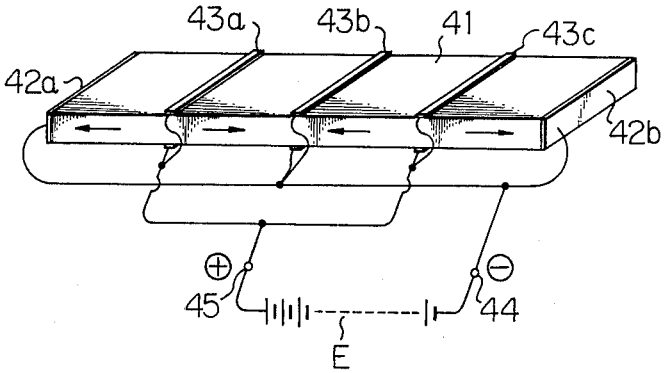
FIG. 1 is a perspective view of a piezoelectric element used in the device according to the present invention, showing schematically an example of the manner of providing electrodes on the element and polarizing the respective sections of the element divided by the electrodes.
Figure 2:
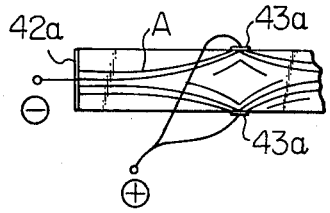
FIG. 2 is a fragmentary magnified elevation of the element shown in FIG. 1, showing schematically electric field distribution occurring in each of the divided section.

Referring first to fundamental structure of the piezoelectric element shown in FIG. 1 to be used in the present invention, a pair of electrodes 42*a* and 42*b* fitted respectively to both opposed end surfaces in the lengthwise direction of a rectangular plate-shaped piezoelectric porcelain 41, which is of, for example, titanic and zirconic acid lead series porcelain, the length of the porcelain is equally divided into any desired number of sections (4 equal divisions in the present embodiment) and divided electrodes 43*a*, 43*b* and 43*c* of a proper width are fitted by any proper known method to the respective divisional lines so as to be parallel with the end surfaces and to be opposed to each other on both of the plate-shaped porcelain 41. In polarizing these electrodes, the both end surface electrodes 42*a* and 42*b* and alternate divided electrode or electrodes (42*b* only in the drawing) are connected to an output terminal 44 of an electric current source E and the other divided electrodes (43*a* and 43*c* in the drawing) are connected to the other output terminal 45. In such case, the directions of the electric field will be opposite to those in adjacent divided sections as shown by the arrows in the dawing, and the electric field distribution within the piezoelectric porcelain will be as shown by such electric field distribution curve A in FIG. 2. While the electrodes are provided on both surfaces of the plate porcelain so as to respectively oppose to each other, it should be noted that, when the thickness of the porcelain plate is comparatively small, the divided electrodes 43*a*, 43*b* and 43*c* may be formed only on either one of the surfaces of the plate. The term "surfaces" means of course the largest surfaces of the plate.

Figure 3:
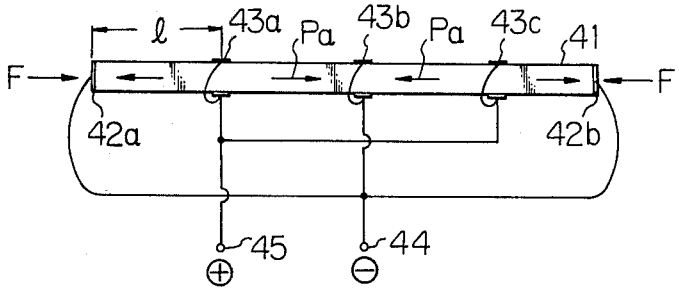
FIG. 3 is an elevation of the element shown in FIG. 1 for explaining generated voltages by a force applied in lengthwise direction to the element.

The current source E is of course not necessary when the porcelain is used as the piezoelectric element. That is, when a compressive force is applied to the above described piezoelectric porcelain 41 by applying a force F in the lengthwise direction as shown in FIG. 3, electric voltages in the directions of the arrows Pa will be generated in the respective divided sections, which voltages are superposed on one another and a high voltage will be obtained between the terminals 44 and 45. Also, when the force F is released to erase the compressive strain, a high voltage of a reverse polarity will be obtained. In such case, the voltage will be proportional to the length $l$ of each divided section for the same compressive force F and the electrostatic capacitance will be the second power of the number $n$ of the divided electrodes or of the divided sections of the porcelain plate, if compared with the element of the same dimensions.

The present invention is to obtain a high voltage with a small operating force by giving the above referred compressive force by means of applying a bending force to the piezoelectric porcelain. For this purpose, as shown in FIG. 4A, the piezoelectric porcelain 41 is reinforced by bonding to it, for example, as insulative plate 46 made of a glass or epoxy material and having a proper elasticity, and this double structure is fixed at one end in the lengthwise direction and a force Fa is applied to the other free end of the structure at right angles and out the side of exposed surface of the insulative plate 46, so that a compressive force will be applied in the lengthwise direction of the piezoelectric porcelain as compressively bent by the bending directional force Fa through the plate 46.

Instead of applying a compressive force in the lengthwise direction of the element as described above, it is also possible to have a voltage generated by applying a tensile force in the lengthwise direction of the piezoelectric porcelain, that is, with the force Fa in reverse direction applied on the side of the element 41. However, in the case of the application of the bent deformation, as in the present instance, the strength of the plate element when the tensile force is given will be about one-tenth the strength when the compressive force is given and, for this reason, such the manner of applying the bending force that will cause the compressive force is preferable. The number of the divisions of the plate element may be properly selected depending on the purpose of using the device.

Figure 4A:
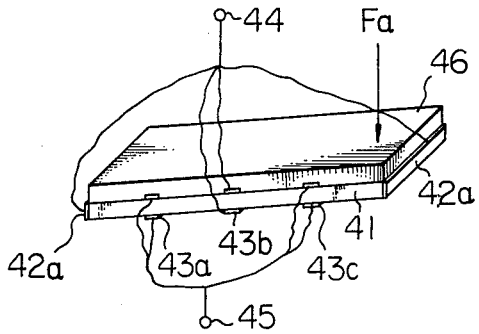
FIG. 4A is a perspective view of an example of a piezoelectric element unit according to the present invention.
Figure 4B:
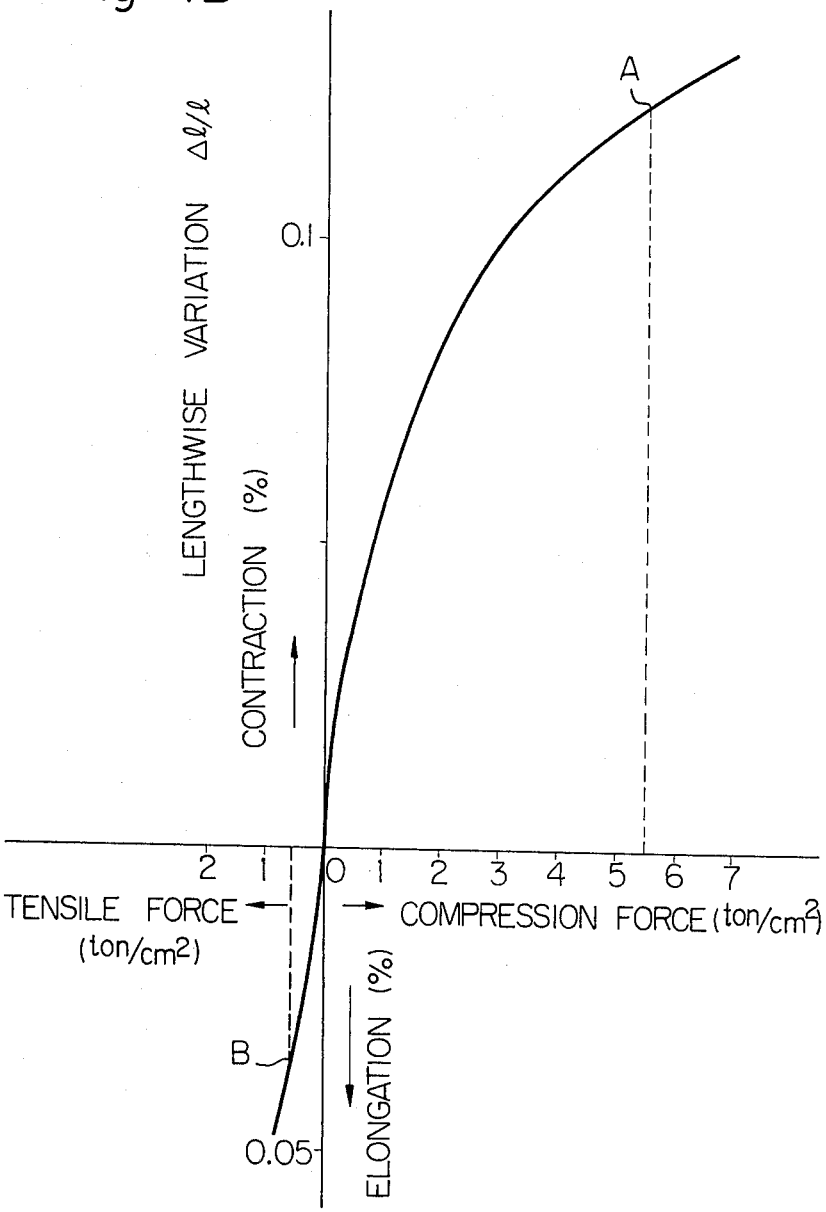
FIG. 4B is a characteristic curve diagram for explaining the durability of the piezoelectric element against compression and tensile forces.

FIG. 4B represents the magnitude of the force applied to the piezoelectric porcelain plate and the elongation and contraction amounts and strength of the piezoelectric porcelain plate in case a compressive force and a tensile force are applied in the lengthwise direction to the plate in the manner of causing the bent deformation. The abscissa represents magnitudes of forces. The right hand side from the origin represents compressive forces and the left hand side represents tensile forces in tons/cm$^2$. The ordinate represents lengthwise variation $\Delta l/l$ of the plate, that is, elongations and contractions in the lengthwise direction of the piezoelectric porcelain plate. The contractions are calibrated above the origin and elongations are calibrated below the origin with the $\Delta l/l$ in percent. As evident from this diagram, it has been made clear by the actual measurement made by the present inventors that, with the compression, the porcelain breaks at the point A, that is, with about 5.5 tons/cm$^2$ but that, with the tension, it breaks at the point B, that is, with about 0.5 tons/cm$^2$. Therefore, in the present invention, a bending force is to be so given that a compressed deformation in the lengthwise direction will be produced in the piezoelectric porcelain.

Figure 5:
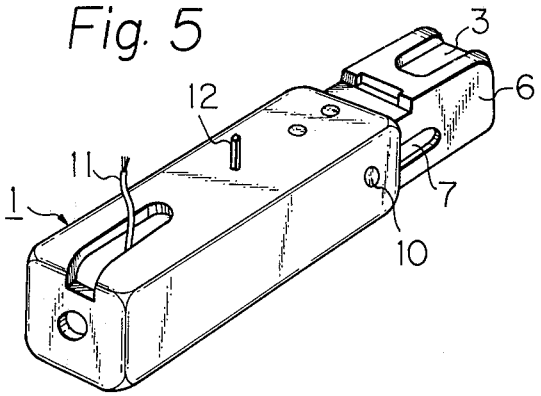
FIG. 5 is a perspective view of an embodiment of the ignition device according to the present invention.
Figure 6:
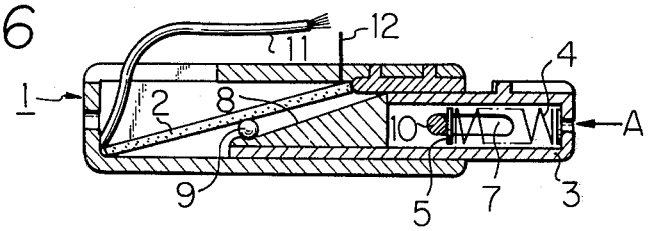
FIG. 6 is a longitudinally sectioned side elevation of the device shown in FIG. 5.
Figure 7:
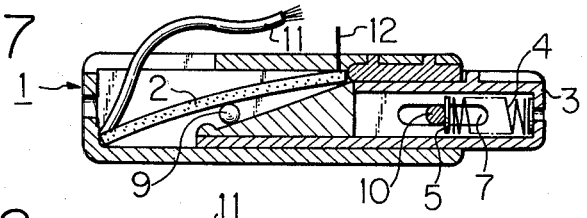
FIG. 7 is a similar view to FIG. 6 showing the operation of the device of FIG. 5.

Referring next to an embodiment of the piezoelectric ignition device of the present invention as shown in FIG. 5 through 7, a piezoelectric element unit 2 having such structure as shown in FIG. 4A, that is, formed by bonding the reinforcing plate in close surface contact to the elongated plate-shaped piezoelectric element having the divisional electrodes on one or both surfaces, is housed in a container 1 so as to be diagonal direction to the container. 3 is an operating member for operating the piezoelectric element unit 2, which member is slidably contained in container 1. Said operating member 3 is provided at the side walls 6 and 6' with elliptic through holes 7, through which a pin 10 passed through the side walls of the container 1 is inserted. A resetting spring 4 is inserted between said pin 10 and the outernal inside wall of the operating member 3. A fixing plate 5 is arranged between said spring 4 and pin 10. Further in the operating member 3, the side of the member facing the piezoelectric element unit is formed to be of a sloped body 8 and the lower part of said sloped body 8 is formed to be a bent or a raised part so as to receive a circular element 9 inserted between the slope 8 and the piezoelectric element side of the unit 2. The piezoelectric element unit 2 is thus arranged as inclined with respect to the moving direction of the slidable operating member 3 so that the piezoelectric element side of the unit 2 will be butted against the element 9 which is freely rollable on the slope 8 as the operating member 3 is pushed inward. Thus the element 9 acts as the force applying member to the unit 2.

Figure 8:
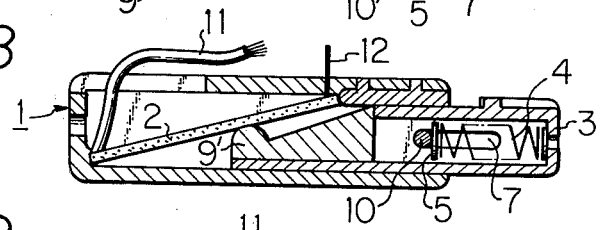
FIG. 8 is a longitudinally sectioned side view of another aspect of the embodiment shown in FIG. 5.

The element 9 need not to roll always but may be the one acting at least to bend the piezoelectric element unit 2 with the movement of the operating body 3. Therefore, it is possible to provide a projection 9' on the sloped body 8*a* at the tip of the operating body 3 so as to be a direct pressing member as shown in FIG. 8. It may be of course possible to provide a projection, as a pressing member, on the lower surface of the piezoelectric element unit 2.

In the respective arrangements as above, the operating member 3 is always given an outward pressing force by the resetting spring 4. 11 is a lead wire for taking out a high voltage generated in the piezoelectric element, and 12 is an earthing side electrode.

The operation of the above emodiments shown in FIGS. 5 through 7 shall be described in the following. When the operating member 3 is pressed in the direction indicated in FIG. 6 by the arrow A against the force of the resetting spring 4, the ball 9 in abutment against the piezoelectric element unit 2 will roll to rise along the slope 8 and will gradually bend the piezoelectric element unit 2 to give a compression force to the element and hence to generate a high voltage. FIG. 7 shows the state at this time. When the pressing force to the member 3 is then released, the operating member 3 will be pressed in a direction reverse to that indicated by the arrow A by the resiliency of the resetting spring 4 and will return to the original state. The embodiment of FIG. 8 also performs the same operation as above.

Figure 9:
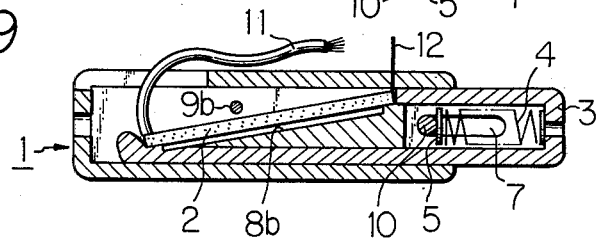
FIG. 9 is a similar side view of still another aspect of the embodiment of FIG. 5.

FIG. 9 shows another embodiment of the ignition device according to the present invention similar to those in FIGS. 5–7 and FIG. 8. In the present instance, however, the piezoelectric element unit 2 is bridged over and along the slope 8*b* of the operating member 3 so as to move together with the operating member 3 and to be bendable toward the slope 8*b*. A pin or crossbar 9*b* is fixed across side walls of the case 1 as a pressing member arranged at right angles to the moving direction of the operating member 3 so that the piezoelectric element of the unit 2 will butt against the pin 9*b* so as to be gradually bent with the movement of the operating member 3. A roller which is fixed or shiftable may be used so as to be a pressing member instead of the pin 9*b*. In such case, as the friction will reduce, the roller will contribute to the reduction of the required operating force.

Figure 10:
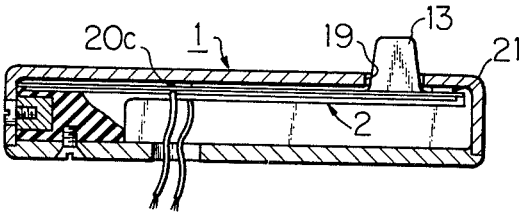
FIG. 10 is a side elevation fragmentary sectioned of another embodiment of the device according to the present invention.
Figure 11A:
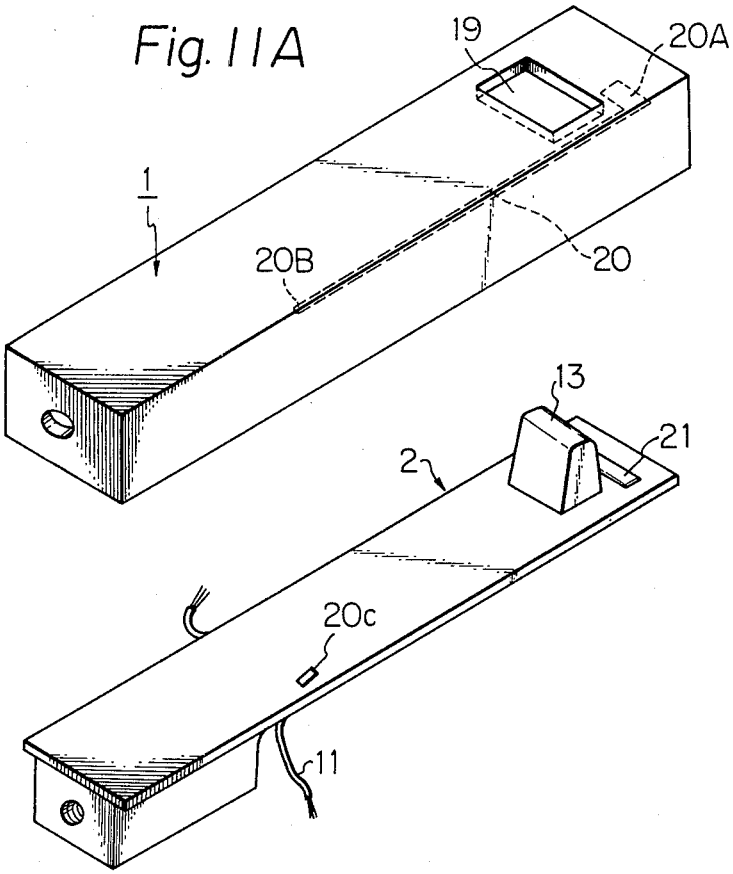
FIG. 11A is a perspective view of the lid of case and piezoelectric element unit and FIG. 11B is a plan view of the lid showing interior thereof.
Figure 11B:
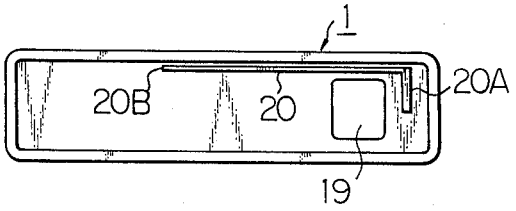
Figure 12A:
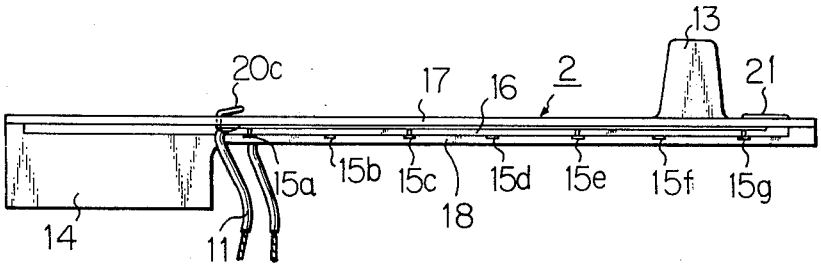
FIG. 12A is a side view thereof and FIG. 12B is a reverse plan view thereof.
Figure 12B:
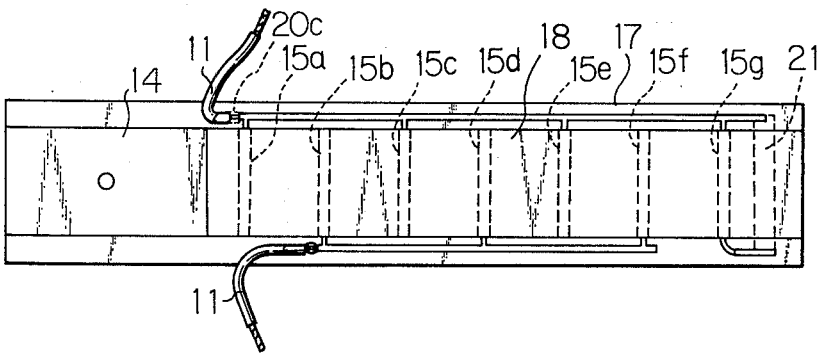

FIGS. 10 to 12 show another embodiment of the ignition device of the present invention. In the drawings, a substantially flat plate-shaped piezoelectric element unit 2 of a cantilevered type is provided with a projection 13 in the upper part and adjacent the free end. To achieve the cantilever aarrangement, a supporting part 14 (see FIG. 12A) is formed at the other end and on the side opposite the side on which said projection 13 is provided. This piezoelectric element unit 2 formed by bonding such insulating plates 17 and 18 as glass or epoxy-printed plates to both surfaces of a piezoelectric porcelain 16 provided with a plurality of divided electrodes 15*a* to 15*g* in the same manner as in the element of FIG. 1. The supporting part 14 may be formed to extend from the insulating plate 18. The piezoelectric element unit 2 of such arrangement is contained through a slight clearance on the lower surface of the upper lid of the container 1 and the supporting part 14 is fixed to the container 2 with a screw 14'. Further, the projection 13 projects out of a hole 19 made in the upper part of the container 1. 11 are lead wires connected respectively to alternate ones of the divided electrodes. That is, as seen in FIG. 12B, the divided electrodes 15*a*, 15*c*, 15*e* and 15*g* are connected with one another and are led out by one of the lead wires 11. In the same manner, the divided electrodes 15*b*, 15*d* and 15*f* are connected with one another and are led out by the other one of the lead wires 11. The inside upper surface of the case 1 is plated with a metal 20 as shown in FIGS. 11A and 11B. This plated metal 20 is arranged at one end 20A in a position corresponding to an electrode plate 21 provided on the upper surface of the piezoelectric element unit 2 and connected with the group of the divided electrodes 15*a*, 15*c*, . . . on one side and is connected at the other end 20B with the group of the divided electrodes 15*b*, 15*d*, . . . on the other side.

The operation of this embodiment shall be referred to next. When the projection 13 is pressed down to apply a pressing force to the free end of the piezoelectric element unit 2, the piezoelectric porcelain 16 will be bent and deformed so as to be compressed in the lengthwise direction due to the bonded plates 17 and 18, so that a high voltage will be generated and will be able to be taken out through the lead wires 11. When the pressing force to the projection 13 is released, the piezoelectric element unit 2 should return to the original state. In this case, as the electrode plate 21 is so arranged as to oppose one end 20A of the plated metal 20 on the inside surface of the case 1 through a slight clearance (for example, preferably of 0.3 to 1 mm), when the piezoelectric element unit 2 returns to the original state, one discharging phenomenon will occur between said electrode plate 21 and said plated metal 20, so as to be effective to erase the discharge residual voltage between discharging electrodes (not illustrated) generated by the pressing operation.

Figure 13:
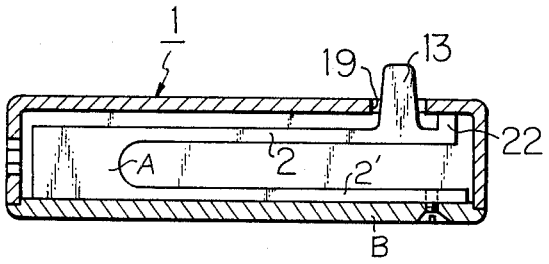
FIG. 13 is a side view of another embodiment of the device according to the present invention with the case sectioned.
Figure 14:
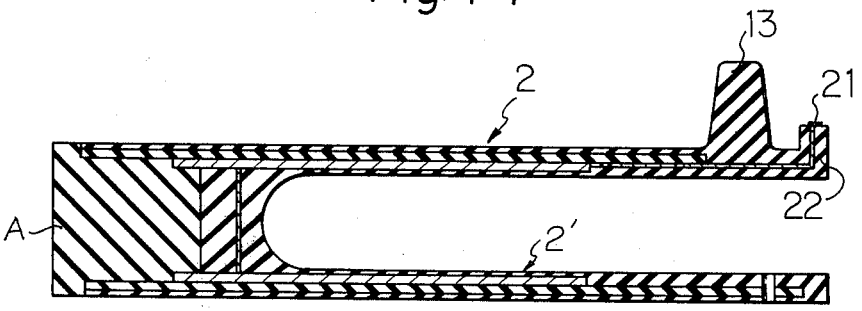
FIG. 14 is a longitudinally sectioned side view of the piezoelectric element unit of the embodiment shown in FIG. 13.
Figure 15:
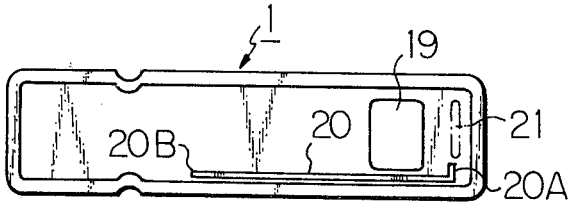
FIG. 15 is a plan view of the lid of case in the embodiment of FIG. 13.

FIGS. 13 to 15 show a further embodiment of the device according to the present invention wherein two piezoelectric element units 2 and 2' are arranged as opposed to each other, each of which is formed in the same manner as in the foregoing embodiments. The piezoelectric element units 2 and 2' parallelly opposed to each other are mechanically coupled at one end through a coupling member A, the piezoelectric element unit 2 is provided with a push button 13 at the other free end and the other piezoelectric element unit 2' is supported at the other end as fixed to a supporting base B. In the present embodiment, the respective groups of the electrodes in both of the piezoelectric element units 2 and 2' are electrically so connected that the respectively superposed voltages of the respective units will be further superposed on each other and more higher voltage will be obtained as a bending force is applied to the units 2 and 2'.

In the arrangement of this embodiment, a pressing force applied downward in FIG. 13 or 14 to the push buttom 13 will cause the upper unit 2 bent downward at the side of the button 13, while the other side and the coupling member A as well will be shifted upward, thereby the lower unit 2' will be bent upward at the side coupled to the member A about the end fixed to the base member B as fulcrum. Thus, it will be seen that the respective piezoelectric element unit 2 and 2' are caused to bend in opposite directions in which the right hand end sides of them will approach one another. For this reason, the reinforcing plate is bonded to each of the piezoelectric elements in the respective units 2 and 2' on the surface reverse to the one opposing to the other unit so that the bending force will be effective to cause the compression force in the longitudinal direction of each element.

Further in the arrangement of the embodiment shown in FIGS. 13 to 15, an elevated part 22 is provided at the free end part of the push button side of the piezoelectric element unit 2 so as to normally contact the inner surface of the case 1 as shown in FIG. 13. On the other hand, an electrode plate 21 which is connected with a group of one polarity of the divided electrodes is provided on the elevated part 22. The inside upper surface of the case 1 is plated with a metal 20 as shown in FIG. 15. This plated metal 20 is so arranged that a slight clearance (for example, preferably of 0.3 to 1 mm) will be formed between its one end 20A and electrode plate 21 in a direction substantially at right angles to the displacing direction of the piezoelectric element unit 2, and that the other end 20B will be connected with the other group of the divided electrodes of the polarity reverse to that of the group connected to the electrode plate 21. Therefore, at the time when the pressing force is released and the piezoelectric element unit 2 returns to the original state, one discharging phenomenon will occur between said electrode plate 21 and the end part 20A of the plated metal 20 so as to erase the discharge residual voltage beween discharging electrodes (not illustrated) due to the voltage generated by the pressing operation.

Figure 16:
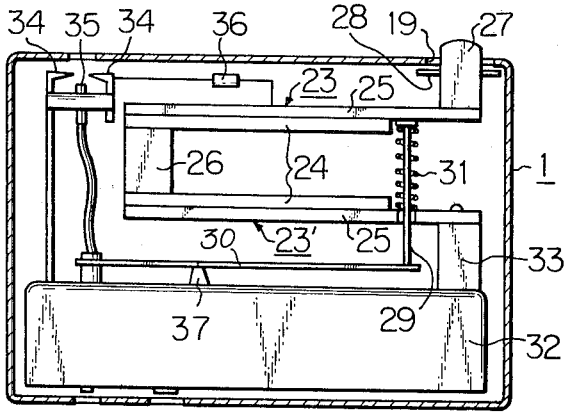
FIGS. 16 to 18 are vertically sectioned side views of various embodiments of the present invention respectively as used for gas lighters.

FIG. 16 shows an example in which a piezoelectric ignition device of the present invention is applied to a cigaret lighter. 23 and 23′ are such a pair of piezoelectric element units as shown in FIGS. 13–15, which is made by bonding such reinforcing plates 25 as, for example, glass or epoxy resin plates to elongated rectangular plate-shaped piezoelectric elements 24 on their opposite side surfaces. The insulating plates 25 project at one end of them further in the lengthwise direction than the piezoelectric elements 24. These piezoelectric element units 23 and 23′ are horizontally parallelly arranagd and are coupled at the other end through a coupling member 26. Such pressing element 27 as an operating button is connected and fixed as directed outward to the projected end of the reinforcing plate 25 of the piezoelectric element unit 23 and projects outward at the upper end through a hole 19 made on the upper surface of the case 1 so as to be able to be pressed. The pressing element 27 is provided with a stopper 28 in a proper place so that no excess deformation will be given to the piezoelectric element unit 23. Further, a rod 29 for opening and closing a valve of gas outlet is connected at the upper end thereof with the piezoelectric element unit 23 and at the other end with a gas opening and closing lever 30 by freely passing through the reinforcing plate of the piezoelectric element unit 23′. In this case, it is preferable to provide the rod 29 with a spring 31 for helping its return. The piezoelectric element unit 23′ is mounted and fixed at the projected end of the plate 25 on a supporting stand 33 fixed, for example, on a fuel tank 32. 34 and 34′ are a pair of discharging electrodes. 35 is a gas nozzle. 36 is a resistance connected at one end with the discharging electrode 34 and at the other end with hot side output end of the piezoelectric elements. 37 is a fulcrum of the gas opening and closing lever 30.

Figure 17:
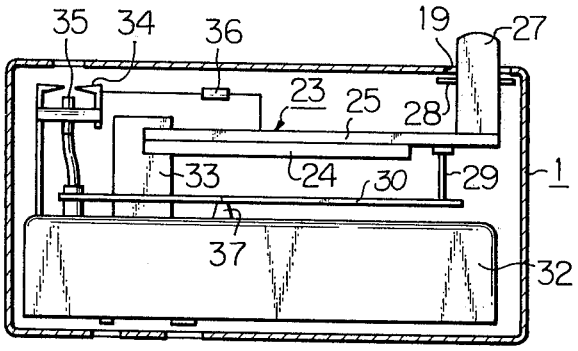

FIG. 17 is of another embodiment similar to that of FIG. 16 of the present invention. In this embodiment, while most components are the same as those in the case of FIG. 16 and are indicated with corresponding reference numerals, only one piezoelectric element unit 23 of the pair of units 23, 23′ in FIG. 16 is used here as held in the cantilever type. That is, the piezoelectric element unit 23 which comprises the insulating plate 25 and piezoelectric element 24 is supported in cantilever shape as fixed at one end on the supporting stand 33 fixed on the fuel tank 32. The other end of the insulating plate 25 extending out of the element 24 is made to be a free end, which has such pressing element 27 as an operating button fixed thereto so as to project out of the case 1, so that the piezoelectric element unit 23 will be bent to deform when the button 27 is depressed. This pressing element 27 is also provided preferably with the stopper 28 at a proper place. Further, the valve opening and closing rod 29 is operatively connected at one end with the piezoelectric element unit 23 and is connected at the other end with the gas opening and closing lever 30 which opens and closes the gas nozzle 35 through the fulcrum 37.

Figure 18:
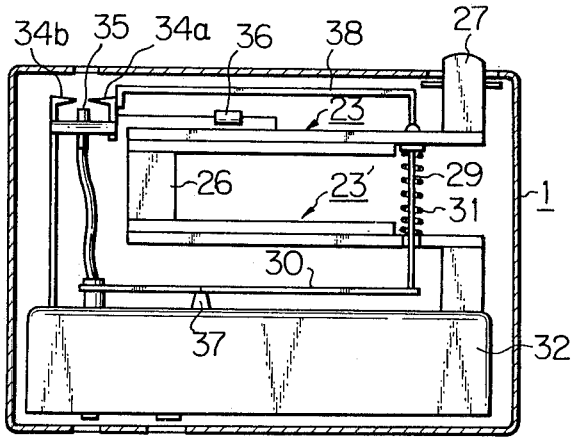

FIG. 18 shows a further embodiment of the present invention, of which structure is similar to that of the foregoing embodiment shown in FIG. 16 except that a short-circuiting element 38 connected at one end with the hot side electrode 34*a* of the discharging electrodes is provided so as to be normally in contact at the other end with the head part of the valve opening and closing rod 29 which is conducted through the lever 30 in the present instance with the earthing side electrode 34*b*. In this embodiment, too, as a pressing force is applied to the pressing element 27, the piezoelectric element 23 will be bent and deformed to generate a voltage in each division of the piezoelectric element 23 and to cause a discharge spark between the discharging electrodes 34*a* and 34*b*. In this case, as the piezoelectric element unit 23 to which the valve opening and closing rod 29 is coupled is bent, the short-circuiting element 38 and valve opening and closing rod 29 will no longer contact each other. At this time, that is, after the pressing operation of the button 27 is terminated, a discharge residual voltage will remain between the discharging electrodes. However, as the depression of the button 27 is released a voltage of an opposite polarity to that generated when the button 27 is depressed is produced and provided to the discharging electrodes, and this voltage of the opposite polarity is caused to be earthed through the short-circuiting element 38 and rod 29 at the moment when these element 38 and rod 29 are come into contact with one another again as the button pressing force is completely released, so as to erase the discharge residual voltage. Therefore, the next operation will be possible to be always started at a zero potential so that the discharging phenomenon will perfectly take place at each time of operation and the ignition will be positively made.

Figure 19:
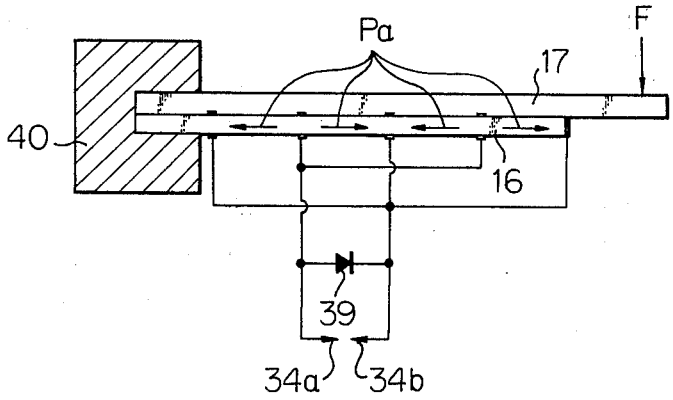
FIG. 19 is a side view of a further embodiment of the present invention showing schematically the formation and electric connection of its essential part.

FIG. 19 shows a further embodiment of the present invention, in which a rectifier 39 is connected in parallel with the discharging electrodes 34*a* and 34*b*, for achieving the same purpose as in the case of FIG. 18. In the drawing, 40 is a supporting stand for supporting at one end the piezoelectric element unit comprising the piezoelectric porcelain 16 and insulating plate 17. When a force F is applied to the insulating plate 17 adjacent the free end thereof to compressively bend the piezoelectric element 16, a voltage in the direction indicated by arrows Pa will be generated in each division of the element 16 a high voltage will be obtained between the discharging electrodes 34*a* and 34*b*. In such case, after the piezoelectric element 16 restores from the bent state, a residual voltage will be present in the discharging gap. However, the residual voltage generated between the discharging electrodes 34*a* and 34*b* can be short-circuited with the rectifier 39 inserted and connected in parallel with the discharging electrodes 34*a* and 34*b*.

What is claimed is:

1. A piezoelectric ignition device for igniting fuel gases comprising at least a piezoelectric element unit which comprises a straight elongated slab of piezoelectric element, a plurality of electrodes provided at least on one surface of said piezoelectric element and transversely with respect to longitudinal direction of the slab so as to divide a length of the slab into a plurality of sections, a pair of output terminals respectively connected with alternate ones of said electrodes, and an elongated slab of an elastic electrically insulative material butted against at least one surface of said piezoelectric element, said piezoelectric element unit being fixed stationary at least at one end; a biasing means engaged to said piezoelectric element unit at least at a position remote from said fixed end of the unit so that, when a biasing force is applied to said means, the piezoelectric element unit will be bowed from its straight condition in a direction to apply a compression stress in the piezoelectric element of the unit in the longitudinal direction thereof; and a pair of stationarily spaced discharging electrodes connected respectively to each of said pair of output terminals so as to cause a spark discharge due to voltages of opposite polarities respectively produced between alternate adjacent ones of the electrodes on the element and provided as superposed to each of the output terminals depending on the compression stress in the piezoelectric element.

2. The device according to claim 1 which comprises a pair of said piezoelectric element units, said pair of units being coupled at their one end so as to be spaced substantially parallel to one another with the piezoelectric elements in opposition, and wherein said fixed end of the unit is an opposite end to said coupled end of one of said pair of the units while said biasing means engages with the other one of the pair of units at an opposite end thereof to said coupled end and at the side of the insulative slab, and said output terminals are respectively connected with alternate ones of said electrodes on each of the pair of units.

3. The device according to claim 2 wherein said insulative slab in each of said pair of piezoelectric elements extends beyond said piezoelectric element at the end opposite to said coupled end, and said fixed end of the one of the elements and said end of the other element which engages the biasing means are said extended ends of the respective insulative slabs.

4. The device according to claim 1 wherein said electrodes are provided on each of longitudinal end surfaces of said piezoelectric element slab and on opposing positions on both surfaces of the slab along respective lines equally dividing the longitudinal length of the slab into a plurality of sections.

5. The device according to claim 1 wherein said insulative slab extends beyond said piezoelectric element at least at opposite end to said fixed end, and said biasing means engages said insulative slab at said extended end.

6. The device according to claim 1 wherein said case is a gas lighter body including a fuel gas reservoir and gas nozzle communicated through a normally closed valve with said reservoir, said bowing and deforming means is a biasing member projecting out of the case and adapted also to open said valve when depressed externally, and said set of discharging electrodes is arranged in front of said gas nozzle.

7. The device according to claim 6 wherein a means for short-circuiting the output of one polarity developing in the discharging electrodes is provided.

8. A piezoelectric ignition device for igniting fuel gases comprising a case, a piezoelectric element supported within said case, said piezoelectric element being formed of a straight rectangular piezoelectric porcelain having at least on one surface thereof a plurality of electrodes dividing the length of the rectangular porcelain into a plurality of divisions, said electrodes being polarized alternately in a reverse direction, and a straight plate-shaped electrically insulative body bonded to said piezoelectric element and made of elastic material, lead wires connected in parallel with said electrodes so that the respective electrodes will be alternately of a reverse polarity, a set of discharging electrodes connected respectively with said lead wires, and a means for bowingly deforming said piezoelectric element and the electrically insulative body from the straight condition with the insulative body on the outside of the bow so as to produce a compressed deformation in the lengthwise direction in said piezoelectric element.

9. The device according to claim 8 wherein said case is opened at one end and includes an operating body contained in said opening of the case so as to be slidable in a direction, said piezoelectric element is fitted within said case so as to be diagonal with respect to said slidable direction of the operating body, and said bowingly deforming means is a member adapted to engage the piezoelectric element at its central position for bowing the same responsive to the sliding of the operating body.

10. The device according to claim 8 wherein said case comprises an electric insulator case and having a hole in one side, said piezoelectric element is supported within said case with one end of the unit fixed to the case, and said bending and deforming means is a biasing member engaged to said insulative body of the piezoelectric element at the other free end thereof and projecting out of said hole of the case.

11. The device according to claim 8 wherein a rectifier is connected in parallel with said discharging electrodes.

12. The device according to claim 8 wherein a means for short-circuiting the output of one polarity developing in the discharging electrodes is provided.

13. The device according to claim 8 wherein a means for electrically leaking the output of one polarity developing in the discharging electrodes is provided.

14. A piezoelectric ignition device for igniting fuel gases comprising a case, piezoelectric element supported within said case, said piezoelectric element being formed of a straight rectangular piezoelectric porcelain having at least on one surface thereof a plurality of electrodes dividing the length of the rectangular porcelain into a plurality of divisions, said electrodes being polarized alternately in a reverse direction, and a straight, plate-shaped electrically insulative body bonded to said piezoelectric element and made of stiff elastic material, lead wires connected in parallel with said electrodes so that the respective electrodes will be alternately of a reverse polarity, a set of sparking electrodes connected respectively to said lead wires, and means for bowingly deforming said piezoelectric element and the electrically insulative body from the straight condition with the insulative body on the outside of the bow so as to produce a compressed deformation in the lengthwise direction in said piezoelectric element, said case being open at one end and including an operating member contained in said opening of the case so as to be slidable in a direction, said piezoelectric element being fitted within said operating member so as to be diagonal with respect to said slidable direction of the operating member, and said bowingly deforming means is a stationary member mounted in the case in the path of movement of the piezoelectric element so that the piezoelectric element will engage said stationary member when the operating member is pressed inwardly into the opening.

15. A piezoelectric ignition device for igniting fuel gases comprising a piezoelectric assembly including a piezoelectric element in the form of a straight elongated slab of piezoelectric material, an insulated mounting element in the form of an elongated slab of elastic material arranged face to face with the piezoelectric element substantially coextensively with it, means for supporting the assembly, an actuator movable with respect to the supporting means for applying manual force to the assembly in a lateral direction for bowing of the assembly, the piezoelectric element being divided into sections having a plurality of positive and negative electrodes, the positive and negative electrodes being wired to produce voltage across a pair of stationarily spaced sparking electrodes, the piezoelectric element being mounted on the concave side of the bow to have greater curvature than the mounting element and bonded to the mounting element so that upon pressing the actuator the piezoelectric element moves from its straight condition to its compressively bowed condition in which a magnified compressive stress exists in the element for production of high sparking voltage at the electrodes upon bowing by relatively light manual forces.

16. The combination as claimed in claim 15 in which the piezoelectric assembly is in the form of separate sections of substantially the same length arranged generally parallel to one another and having means for interconnecting them cantilever fashion to define a free end and an anchored end, the anchored end being connected to the support, the actuator being movable laterally against the free end and in the direction perpendicular to the anchored end so that both of the sections of piezoelectric element are bowed to set up compressive stress therein upon exerting manual force upon the actuator.

17. The combination as claimed in claim 15 in which the support is in the form of a case having an elongated recess, the piezoelectric assembly being supported at its ends at a shallow angle diagonally in the recess, the actuator being movable endwise in the recess and having means thereon for engaging the central portion of the piezoelectric assembly for bowing the same to place the piezoelectric element in compression as the actuator is pressed inwardly.

18. The combination as claimed in claim 15 including a case having an elongated recess, the supporting means being in the form of a plunger mounting the piezoelectric assembly in diagonal orientation, the plunger being slidable in the recess upon application of manual force thereto, the actuator being fixed in the case in the path of movement of the piezoelectric assembly so that when the plunger is pressed inwardly the actuator engages the piezoelectric element at a shallow angle bowing the same for the setting up of compressive force in the piezoelectric element, and a return spring interposed between the case and the plunger for returning the plunger to a normal extended position.

19. The combination as claimed in claim 15 in which a rectifier is connected in parallel with the electrodes and polarized to act as an insulator when the actuator is manually pressed and to act as a conductor when the manual actuator is released thereby to restore the piezoelectric element to reference condition for a subsequent manual pressure stroke.

20. The combination as claimed in claim 15 in which a short circuiting element is normally positioned across the electrodes and in which the actuator is mechanically coupled to the short circuiting element for disconnecting it from one of the electrodes incident to manually pressing the actuator and for reconnecting it when manual pressure is released thereby to restore the piezoelectric element to reference condition for a subsequent manual pressure stroke.

21. A cigarette lighter comprising, in combination, a case, a fuel tank for pressurized gaseous fuel and having a valve and nozzle, a piezoelectric assembly including a piezoelectric element in the form of an elongated slab of piezoelectric material, an insulated mounting element in the form of an elongated slab of elastic material arranged face to face with the piezoelectric element substantially coextensively with it, means for supporting the assembly within the case while permitting bowing movement, a manual actuator movably mounted with respect to the case for applying manual force to the piezoelectric assembly in a lateral direction for bowing of the assembly, stationarily spaced sparking electrodes adjacent the nozzle spaced to define a spark gap, positive and negative electrodes on the piezoelectric element connected to the sparking electrodes to form a high voltage sparking circuit, the piezoelectric element being bonded to the mounting element and arranged on the concave side of the bow so that it takes on greater curvature than the mounting element with the result that a magnified compressive stress exists in the piezoelectric element for production of a high sparking voltage at the sparking electrodes upon application to the actuator of relatively light manual force, and means for interconnecting the manual actuator with the valve so that when the actuator is pressed fuel is released at the nozzle for ignition by the spark to produce a flame which persists as long as the actuator is depressed.

* * * * *